US009644809B2

(12) United States Patent
Ikuta et al.

(10) Patent No.: US 9,644,809 B2
(45) Date of Patent: May 9, 2017

(54) LIGHT SOURCE UNIT

(71) Applicant: KOITO MANUFACTURING CO., LTD., Tokyo (JP)

(72) Inventors: Ryujiro Ikuta, Shizuoka (JP); Takayuki Otsubo, Shizuoka (JP); Atsushi Ozawa, Shizuoka (JP); Takuya Serita, Shuizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 115 days.

(21) Appl. No.: 14/607,670

(22) Filed: Jan. 28, 2015

(65) Prior Publication Data

US 2015/0211725 A1 Jul. 30, 2015

(30) Foreign Application Priority Data

Jan. 28, 2014 (JP) ..... 2014-013132
Dec. 1, 2014 (JP) ..... 2014-243036

(51) Int. Cl.
*F21S 8/10* (2006.01)

(52) U.S. Cl.
CPC ..... *F21S 48/1109* (2013.01); *F21S 48/1113* (2013.01); *F21S 48/1154* (2013.01);
(Continued)

(58) Field of Classification Search
CPC ... F21K 9/1375; F21S 48/1154; F21S 48/215; F21S 48/321; F21S 48/328; F21S 8/10;
(Continued)

(56) References Cited

U.S. PATENT DOCUMENTS 7,300,173 B2 * 11/2007 Catalano ..... F21V 7/06 362/203
7,976,335 B2 * 7/2011 Weber ..... F21V 23/06 313/317

(Continued)

FOREIGN PATENT DOCUMENTS

CN 102222736 A * 10/2011
JP 2011-129308 A 6/2011

(Continued)

OTHER PUBLICATIONS

Extended European Search Report issued in corresponding European Application No. 15152883.3, mailed on Jul. 8, 2015 (8 pages).

*Primary Examiner* — Hargobind S Sawhney
(74) *Attorney, Agent, or Firm* — Osha Liang LLP

(57) ABSTRACT

A light source unit includes a socket, a heat dissipation member, a board and a semiconductor light emitting element. The socket has a first thermal conductivity and includes a portion that defines a first side and a second side. The heat dissipation member has a second thermal conductivity being higher than the first thermal conductivity. The board is disposed on the first side. The semiconductor light emitting element is supported by the board. The socket is an injection-molded member. The heat dissipation member includes a first portion and a second portion. The first portion is disposed on the first side, extends in a first direction, and supports the board. The second portion includes a portion extending in a second direction intersecting with the first direction, as a result of being subjected to bending processing. A part of the second portion is disposed on the second side.

8 Claims, 11 Drawing Sheets

(52) U.S. Cl.
CPC ..... *F21S 48/1225* (2013.01); *F21S 48/1323* (2013.01); *F21S 48/321* (2013.01); *F21S 48/328* (2013.01)

(58) Field of Classification Search
CPC .. F21S 48/1104; F21S 48/1109; F21S 48/115; F21S 48/212; F21V 19/0005; F21V 19/001; F21V 19/003; F21V 23/005; F21V 29/2212; F21V 29/713; F21V 31/005; F21V 17/164; F21V 29/507; F21Y 2101/02; F21Y 2103/003; F21Y 2103/10; F21Y 2105/10; F21L 4/027
See application file for complete search history.

(56) References Cited

U.S. PATENT DOCUMENTS 9,217,555 B2 * 12/2015 Farmer ..... F21V 29/20
9,377,185 B2 * 6/2016 Preuschl ..... F21V 23/06
2004/0222502 A1 * 11/2004 Hsu ..... H01L 33/62 257/678
2006/0002125 A1 * 1/2006 Kim ..... F21K 9/00 362/509
2006/0033117 A1 * 2/2006 Takekuma ..... H01L 33/486 257/99
2007/0246727 A1 * 10/2007 Chen ..... H01L 33/62 257/99
2010/0177515 A1 * 7/2010 Shoushtari ..... F21V 19/045 362/249.02
2011/0095690 A1 4/2011 Sagal
2011/0128730 A1 * 6/2011 Chiu ..... F21K 9/137 362/235
2011/0169407 A1 * 7/2011 Hasnain ..... F21V 23/0442 315/32
2012/0293652 A1 * 11/2012 Farmer ..... F21V 29/20 348/143
2013/0033165 A1 * 2/2013 Terazawa ..... F21V 29/004 313/46
2014/0197445 A1 * 7/2014 Saito ..... H01L 33/642 257/99

FOREIGN PATENT DOCUMENTS

JP 2012-119243 A 6/2012
JP 2013-235649 A 11/2013
TW DE 102013100611 A1 * 11/2013 ..... H01L 25/0753
WO 2011/078217 A1 6/2011

* cited by examiner

LIGHT SOURCE UNIT

CROSS REFERENCE TO RELATED APPLICATION(S)

This application is based on and claims priority under 35 U.S.C. §119 to Japanese Patent Application Nos. 2014-013132 (filed on Jan. 28, 2014) and 2014-243036 (filed on Dec. 1, 2014), the entire contents of which are incorporated herein by reference.

BACKGROUND

1. Technical Field

Exemplary embodiments of the invention relate to a light source unit to be incorporated in an illumination device which is to be mounted in a vehicle.

2. Related Art

For example, JP 2012-119243 A describes a light source unit to be incorporated in an illumination device which is to be mounted in a vehicle. This light source unit employs a semiconductor light emitting element as a light source. To dissipate heat that is generated in association with light emission, a board that supports the semiconductor light emitting element is fixed on a heat dissipation member.

SUMMARY

One exemplary of the invention secure a sufficient level of heat dissipation in a light source unit to be incorporated in an illumination device which is to be mounted in a vehicle, while satisfying demands such as miniaturization and weight reduction of the light source unit.

(1) According to one exemplary embodiment, a light source unit includes a socket, a heat dissipation member, a board and a semiconductor light emitting element. The socket has a first thermal conductivity and includes a portion that defines a first side and a second side. The heat dissipation member has a second thermal conductivity being higher than the first thermal conductivity. The board is disposed on the first side. The semiconductor light emitting element is supported by the board. The socket is an injection-molded member. The heat dissipation member includes a first portion and a second portion. The first portion is disposed on the first side, extends in a first direction, and supports the board. The second portion includes a portion extending in a second direction intersecting with the first direction, as a result of being subjected to bending processing. A part of the second portion is disposed on the second side.

Semiconductor light emitting elements generate a large amount of heat in association with light emission. To dissipate such heat efficiently, it is preferable to form a socket with a metal. On the other hand, from the viewpoints of moldability, weight reduction, cost reduction, etc., there is a demand that the socket be made from, for example, an injection-moldable resin material. However, in general, such materials are lower in thermal conductivity than metals. The inventors conceived that the heat dissipation performance can be enhanced while such demands as high moldability, weight reduction, and cost reduction are satisfied by combining a socket that is an injection-molded member having a first thermal conductivity with a heat dissipation member made from a material having a second thermal conductivity that is higher than the first thermal conductivity.

Specifically, the heat dissipation member is formed so as to have a portion that extends in a direction intersecting with a direction in which a first portion extends. The first portion is disposed on a first side, defined by a portion of a socket, of a light source unit and supports a board which supports a semiconductor light emitting element. A part of the second portion is disposed on the second side, defined by the portion of the socket, of the light source unit. Heat generated by the semiconductor light emitting element is guided (transferred) to the second portion via the first portion and dissipated efficiently on the second side of the light source unit.

Furthermore, the inventors found that forming the heat dissipation member by bending a plate member makes it possible to secure a larger surface area with a smaller volume than forming a block-shaped heat dissipation member by cutting processing or the like. That is, as a result of being subjected to bending processing, the second portion of the heat dissipation member is formed so as to have a portion that extends in the direction that intersecting with the direction in which the first portion extends. This makes it possible to satisfy both of weight reduction and high heat dissipation performance of the heat dissipation member. The presence of the heat dissipation member lowers the necessity to increase the volume of the socket and hence enables weight reduction and miniaturization of the entire light source unit. As a result, sufficient heat dissipation performance can be secured while such demands as weight reduction and miniaturization of the light source unit to be incorporated in an illumination device that is to be mounted in a vehicle are satisfied.

(2) The light source unit of (1) may further include a conduction terminal. The conduction terminal electrically connects to the semiconductor light emitting element. The socket includes a connector portion that houses a tip of the conduction terminal. The connector portion is formed with an opening that is located on the second side. A tip of the second portion is more distant from the first portion in the second direction than the tip of the conduction terminal is.

Since the socket is the injection-molded member, the socket can easily be molded integrally with the connector portion which is relatively complex in shape. With the above configuration, a power supply path to the semiconductor light emitting element is disposed inside the socket. Since the heat dissipation member is formed by the bending processing, it can be miniaturized while being kept high in heat dissipation performance. Also, a space produced resultantly can be utilized to form a power supply path to the semiconductor light emitting element. As a result, although the power supply path to the semiconductor light emitting element is disposed inside the socket, size increase of the socket and resulting size increase of the light source unit can be suppressed.

To further enhance the heat dissipation performance of the heat dissipation member even, it is preferable to increase a surface area of the part, disposed on the second side of the light source unit, of the second portion. With the above configuration, this requirement can be met easily. As a result, sufficient heat dissipation performance can be secured more easily while such demands as miniaturization and weight reduction of the light source unit to be incorporated in an illumination device which is to be mounted in a vehicle are satisfied.

(3) In the light source unit of any of (1) to (2), the socket may include plural heat radiation fins that are arranged on the second side. The second portion may be disposed outside a region where the plural heat radiation fins of the socket are arranged.

Since the socket is the injection-molded member, the socket can easily be molded integrally with the plural heat radiation fins which are relatively complex in shape. This makes it possible to further enhance the heat dissipation performance of the light source unit. Where the heat dissipation member is made from a metal or the like, it has higher in rigidity than the heat radiation fin which is injection-molded so as to be thin to increase the surface area. Providing the part of the second portion outside the region of the socket where the plural heat radiation fins are arranged makes it possible to protect, from an external force, the heat radiation fins which are relatively lower in rigidity. As a result, sufficient heat dissipation performance can be secured more easily while such demands as miniaturization and weight reduction of the light source unit to be incorporated in an illumination device that is to be mounted in a vehicle are satisfied.

(4) In the light source unit of any one of (1) to (3), at least part of the heat dissipation member may be integration-molded with the socket.

In this case, a molding die for the socket can be made simpler than in a case where the socket and the heat dissipation member are integrated together by inserting the second portion of the heat dissipation member into a hole formed that is in the socket. Furthermore, since the socket and the heat dissipation member are fixed to each other so as to be in close contact with each other, not only can the heat dissipation performance of the heat dissipation member be enhanced but also entrance of water or dust through the connection portion between the socket and the heat dissipation member can be prevented. Still further, since a step of inserting the second portion into a hole is not necessary, the degree of freedom to select a shape of the portion, provided inside the socket, of the second portion is increased. For example, if the second portion is formed so as to have plural bent portions inside the socket, the heat dissipation performance can be enhanced further without increase of the size of the socket. As a result, not only can sufficient heat dissipation performance be secured more easily while such demands as miniaturization and weight reduction of the light source unit to be incorporated in an illumination device that is to be mounted in a vehicle are satisfied, but also the semiconductor light emitting element can be protected from water and dust.

(5) In the light source unit of any one of (1) to (3), a hole may open on the first side is formed in the socket. The second portion may be inserted in the hole so that the heat dissipation member and the socket are integrated together.

In this case, the assembling work efficiency can be enhanced in providing the light source unit that can secure sufficient heat dissipation performance while satisfying such demands as miniaturization and weight reduction.

(6) In the light source unit of (5), the hole may be a through hole. The light source unit may further include a sealing member that fills a space between the second portion and an inner wall surface of the through hole.

With this configuration, even in the case where the socket and the heat dissipation member are integrated together by inserting the second portion into the through hole, entrance of water or dust into a very small gap between the socket and the second portion can be prevented. As a result, in providing the light source unit that can secure sufficient heat dissipation performance while satisfying such demands as miniaturization and weight reduction, not only can the assembling work efficiency be increased but also the semiconductor light emitting element can be protected from water and dust.

DETAILED DESCRIPTION

Figure 1A:
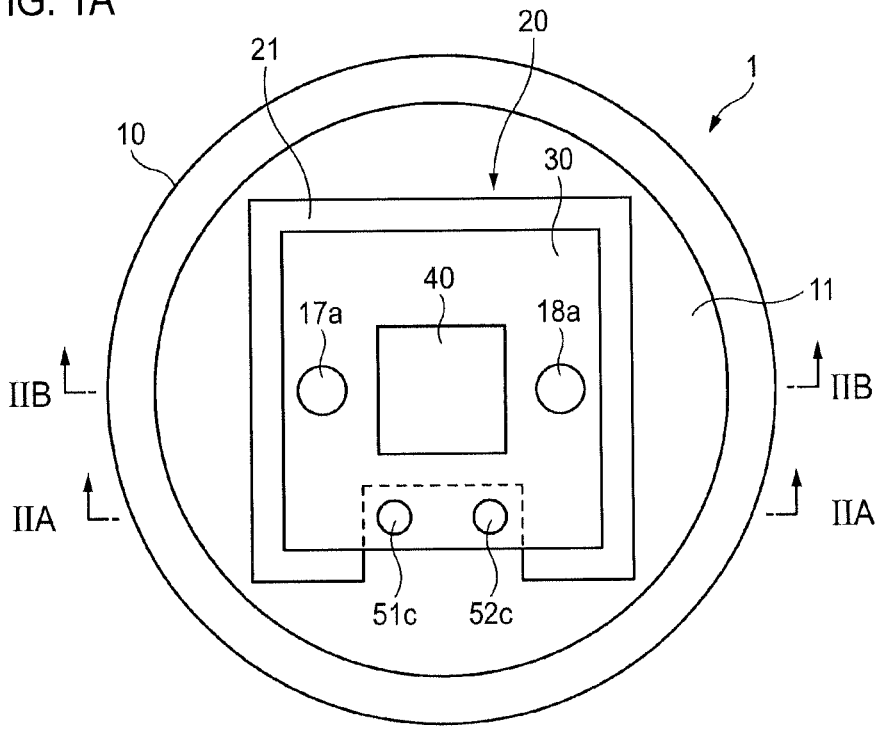
FIG. 1A is a plan view showing appearances of a light source unit according to a first exemplary embodiment.

Exemplary embodiments of the invention will be hereinafter described in detail with reference to the accompanying drawings. In the drawings, the scale is changed as appropriate to draw individual members in recognizable sizes. Expressions "front/rear," "right/left," and "up/down" are used just for convenience of description and should not be construed as restricting a posture or direction in actual use.

Figure 1B:
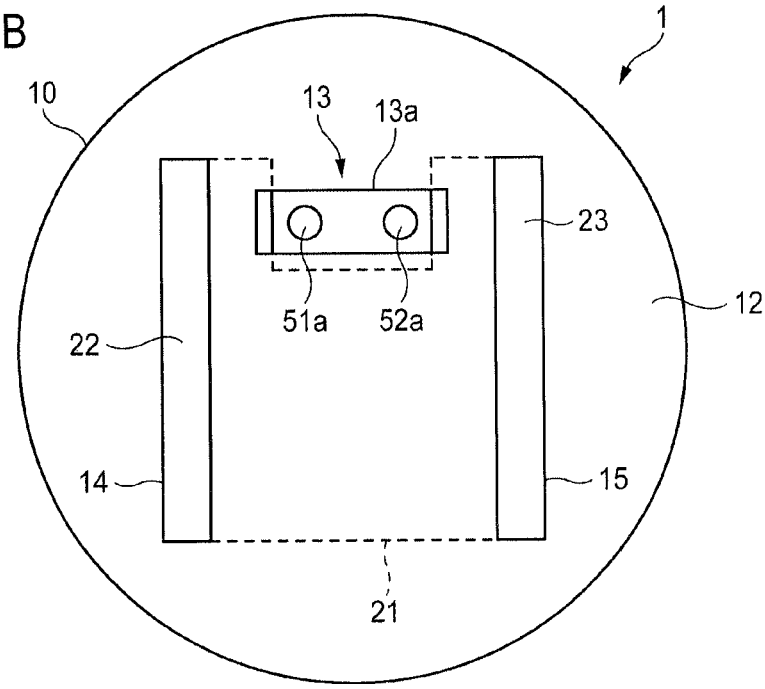
FIG. 1B is a bottom view showing the appearances of the light source unit according to the first exemplary embodiment
Figure 2A:
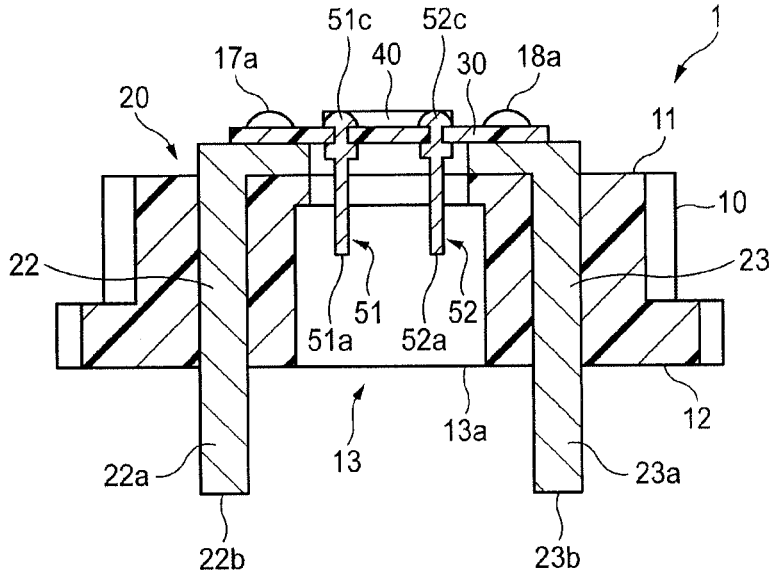
FIGS. 2A and 2B are sectional views showing the configuration of the light source unit.
Figure 2B:
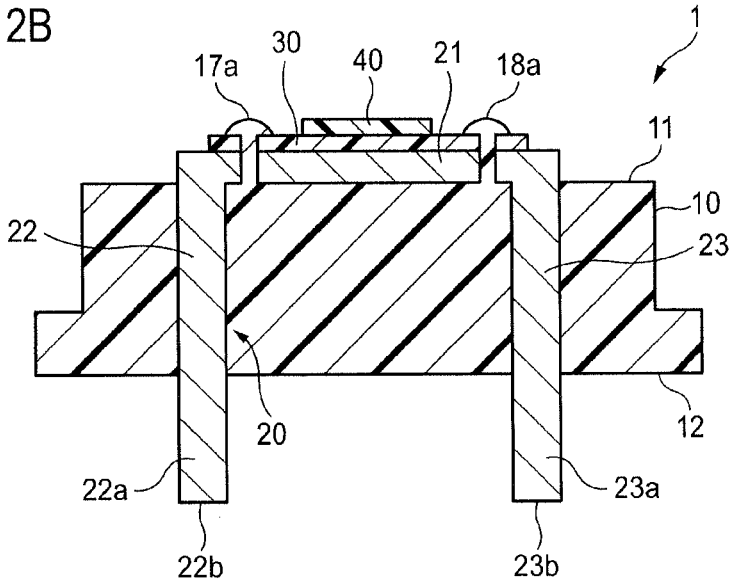

FIG. 1A is a plan view showing appearances of a light source unit 1 according to a first exemplary embodiment. FIG. 1B is a bottom view showing the appearances of the light source unit 1. FIG. 2A is a sectional views taken along a line IIA-IIA in FIG. 1A and viewed from a directions of an arrow shown in FIG. 1A. FIG. 2B is a sectional views taken along a line IIB-IIB in FIG. 1A and viewed from a directions of an arrow shown in FIG. 1A.

The light source unit 1 is equipped with a socket 10. The socket 10 has a first surface 11 and a second surface 12. The first surface 11 and the second surface 12 face opposite sides to each other. The socket 10 includes a portion that defines a first side of the light source unit 1 and a second side of the light source unit 1. The first side is a side where the first surface 11 exists. The second side is a side where the second surface 12 exists.

The light source unit 1 is also equipped with a heat dissipation member 20. A material of the heat dissipation member 20 is higher in thermal conductivity than that of the socket 10. That is, the socket 10 has a first thermal conductivity, and the heat dissipation member 20 has a second thermal conductivity that is higher than the first thermal conductivity. The socket 10 is an injection-molded member made from a resin material. The resin material may be mixed with glass fillers or metal powders. An example material of the heat dissipation member 20 is a metal such as aluminum.

The heat dissipation member 20 is provided with a board support portion 21 (an example of a first portion). The board support portion 21 is placed on the first surface 11 of the socket 10. That is, the board support portion 21 is disposed on the first side of the light source unit 1. The board support portion 21 extends to be in parallel to the first surface 11 of the socket 10 (the direction parallel to the first surface 11 is an example of a first direction).

The heat dissipation member 20 is also provided with a first heat dissipation plate 22 (an example of a second portion) and a second heat dissipation plate 23 (another example of the second portion). As a result of being subjected to bending processing, the first heat dissipation plate 22 and the second heat dissipation plate 23 have portions that extend in a direction (an example of a second direction) that intersects with the direction in which the board support portion 21 extends. The first heat dissipation plate 22 has a first projection portion 22*a* (an example of a part of the second portion). The first projection portion 22*a* projects from the second surface 12 of the socket 10. That is, the first projection portion 22*a* is disposed on the second side of the light source unit 1. The second heat dissipation plate 23 has a second projection portion 23*a* (another example of the part of the second portion). The second projection portion 23*a* projects from the second surface 12 of the socket 10. That is, the second projection portion 23*a* is disposed on the second side of the light source unit 1.

The light source unit 1 is equipped with a board 30. The board 30 is supported by the board support portion 21 of the heat dissipation member 20. That is, the board 30 is disposed on the first side of the light source unit 1.

The light source unit 1 is also equipped with a semiconductor light emitting element 40. The semiconductor light emitting element 40 is used as a light source of the light source unit 1. For example, the semiconductor light emitting element 40 is a light-emitting diode (LED) which emits light of a predetermined color. Alternatively, the semiconductor light emitting element 40 may be a laser diode or an organic EL device in place of the LED. The semiconductor light emitting element 40 is supported by the board 30. That is, the semiconductor light emitting element 40 is disposed on the first side of the light source unit 1.

The semiconductor light emitting element 40 generates much heat as it emits light. To dissipate this heat efficiently, it is preferable that the socket 10 is made of a metal. On the other hand, from the viewpoints of moldability, weight reduction, cost reduction, etc., there is a demand that the socket 10 be made of an injection-moldable resin material, for example. However, in general, such materials are lower in thermal conductivity than metals. The inventors has conceived that a combination of (i) the socket 10 that is an injection-molded member having the first thermal conductivity and (ii) the heat dissipation member 20 made of a material having the second thermal conductivity that is higher than the first thermal conductivity can enhance the heat dissipation performance while satisfying such demands as high moldability, weight reduction, and cost reduction.

More specifically, the heat dissipation member 20 is formed so that the first heat dissipation plate 22 and the second heat dissipation plate 23 have the portions, which extend in the direction intersecting the direction in which the board support portion 21 extends. The board support portion 21 is disposed on the first side, defined by the portion of the socket 10, of the light source unit 1. The board support portion 21 supports the board 30 which supports the semiconductor light emitting element 40. The first projection portion 22*a* of the first heat dissipation plate 22 and the second projection portion 23*a* of the second heat dissipation plate 23 are disposed on the second side, defined by the portion of the socket 10, of the light source unit 1. Heat generated by the semiconductor light emitting element 40 is guided (transferred) to the first heat dissipation plate 22 and the second heat dissipation plate 23 via the board support portion 21 and is dissipated efficiently on the second side of the light source unit 1.

Figure 9A:
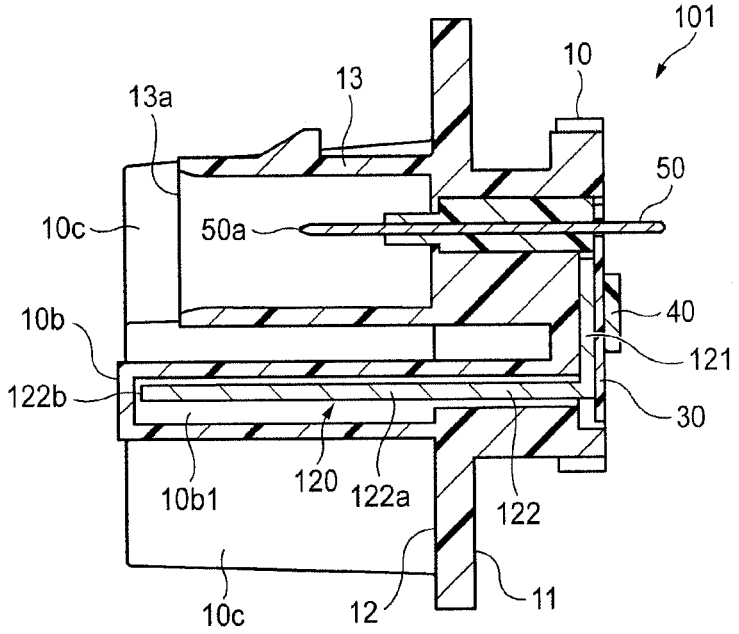
FIG. 9A is a sectional view showing the configuration of the light source unit according to the second exemplary embodiment.
Figure 9B:
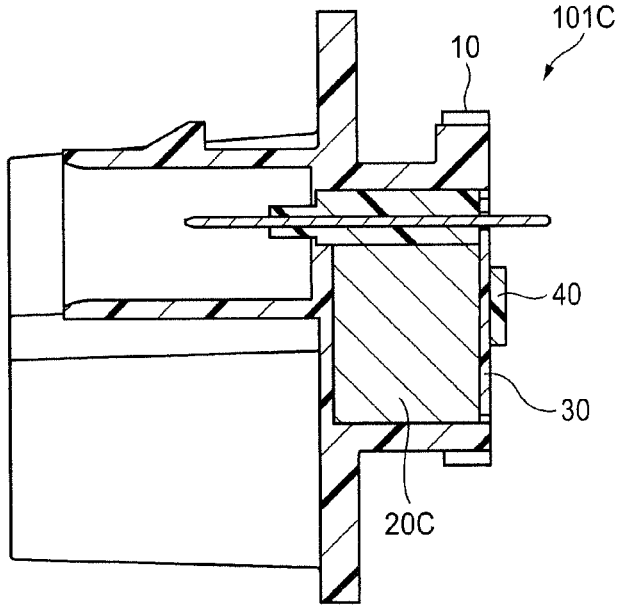
FIG. 9B is a sectional view showing the configuration of a light source unit of a comparative example.

The inventors also found that forming the heat dissipation member 20 by bending a plate member makes it possible to secure a larger surface area with a smaller volume than forming a block-shaped heat dissipation member by cutting processing or the like (also refer to a comparative example shown in FIG. 9B). That is, as a result of being subjected to the bending processing, the first heat dissipation plate 22 and the second heat dissipation plate 23 of the heat dissipation member 20 are formed so as to have the portions, which extend in the direction interesting with the direction in which the board support portion 21 extends. This configuration satisfies both of weight reduction and high heat dissipation performance of the heat dissipation member 20. The presence of the heat dissipation member 20 lowers the necessity to increase the volume of the socket 10 and hence enables weight reduction and miniaturization of the entire light source unit 1. As a result, sufficient heat dissipation performance can be secured while such demands as weight reduction and miniaturization of the light source unit 1 to be incorporated in an illumination device which is to be mounted in a vehicle are satisfied.

As shown in FIG. 2A, the light source unit 1 is equipped with a first conduction terminal 51 and a second conduction terminal 52. The first conduction terminal 51 and the second conduction terminal 52 are supported by the board 30. The first conduction terminal 51 and the second conduction terminal 52 electrically connect to the semiconductor light emitting element 40 via circuit interconnections (not shown) formed on the board 30. The first conduction terminal 51 is, for example, a power supply terminal. Also, the second conduction terminal 52 is, for example, a ground terminal.

As shown in FIGS. 1B and 2A, the socket 10 is equipped with a connector portion 13. The connector portion 13 houses a tip 51*a* of the first conduction terminal 51 and a tip 52*a* of the second conduction terminal 52. The connector portion 13 is formed with an opening 13*a*. The opening 13*a* opens on the second surface 12 of the socket 10. That is, the opening 13*a* is located on the second side of the light source unit 1.

Since the socket 10 is an injection-molded member, the socket 10 can be easily molded integrally with the connector portion 13 which is relatively complex in shape. With the above-described configuration, a power supply path to the semiconductor light emitting element 40 is disposed inside the socket 10. However, since the heat dissipation member 20 is formed by bending processing, it can be miniaturized while being kept high in heat dissipation performance. A space produced resultantly can be utilized to form a power supply path to the semiconductor light emitting element 40. As a result, although the power supply path to the semiconductor light emitting element 40 is disposed inside the socket 10, size increase of the socket 10 and resulting size increase of the light source unit 1 can be suppressed.

As shown in FIG. 2A, the tip 22*b* of the first heat dissipation plate 22 and the tip 23*b* of the second heat dissipation plate 23 are more distant from the board support portion 21 in the direction intersecting with the direction in which the board support portion 21 extends, than the tip 51*a* of the first conduction terminal 51 and the tip 52*a* of the second conduction terminal 52 are.

To make the heat dissipation performance of the heat dissipation member 20 even higher, it is preferable to increase the surface areas of the first projection portion 22*a* of the first heat dissipation plate 22 and the second projection portion 23*a* of the second heat dissipation plate 23 which are disposed on the second side of the light source unit 1. With the above-described configuration, this requirement can be met easily. As a result, sufficient heat dissipation performance can be secured more easily while such demands as miniaturization and weight reduction of the light source unit 1 to be incorporated in an illumination device which is to be mounted in a vehicle are satisfied.

Figure 3:
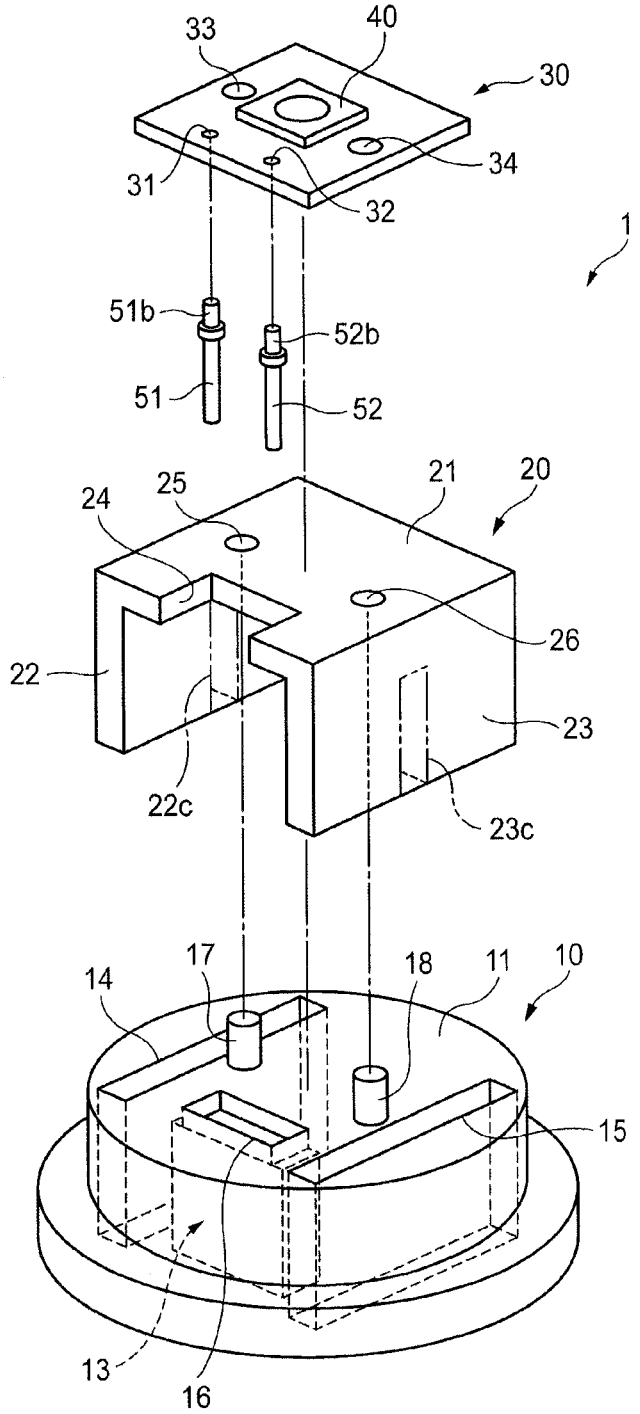
FIG. 3 is an exploded perspective view showing the configuration of the light source unit.

Next, a method for assembling the light source unit 1 having the above-described configuration will be described. FIG. 3 is an exploded perspective view showing the configuration of the light source unit 1.

As described above, the socket 10 is formed by injection molding. The socket 10 is formed with a first through hole 14, a second through hole 15, and a third through hole 16. Each of the first through hole 14, the second through hole 15, and the third through hole 16 extends so as to communicate the first surface 11 and the second surface 12 with one another. The socket 10 also has a first positioning projection 17 and a second positioning projection 18. The first positioning projection 17 and the second positioning projection 18 are provided on the first surface 11.

As described above, the heat dissipation member 20 is formed by bending a plate member so that the first heat dissipation plate 22 and the second heat dissipation plate 23 has the portions, which extends in the direction intersecting with the direction in which the board support portion 21 extends. The board support portion 21 is formed with a recess 24, a first positioning hole 25, and a second positioning hole 26.

The board 30 is formed with a first positioning hole 31, a second positioning hole 32, a third positioning hole 33, and a fourth positioning hole 34.

An upper end potion 51*b* of the first conduction terminal 51 is inserted in the first positioning hole 31 of the board 30. As shown in FIGS. 1A and 2A, the first conduction portion 51*c* is formed on the upper end potion 51*b* by soldering or the like. The first conduction portion 51*c* electrically connects to the semiconductor light emitting element 40 via the circuit interconnection (not shown) formed on the board 30.

An upper end potion 52*b* of the second conduction terminal 52 is inserted in the second positioning hole 32 of the board 30. As shown in FIGS. 1A and 2A, the second conduction portion 52*c* is formed on the upper end potion 52*b* by soldering or the like. The second conduction potion 52*c* electrically connects to the semiconductor light emitting element 40 via the circuit interconnection (not shown) formed on the board 30.

The socket 10 and the heat dissipation member 20 are integrated together by inserting the first heat dissipation plate 22 and the second heat dissipation plate 23 into the first through hole 14 and the second through hole 15, respectively.

In this case, the assembling work efficiency can be enhanced in providing the light source unit 1 which can secure sufficient heat dissipation performance while satisfying such demands as miniaturization and weight reduction.

At this time, the first positioning projection 17 and the second positioning projection 18 of the socket 10 are respectively inserted into the first positioning hole 25 and the second positioning hole 26, which are formed through the board support portion 21. As a result, the recess 24 formed in the board support portion 21 is positioned above the third through hole 16.

Subsequently, the board 30 which supports the semiconductor light emitting element 40 is connected to the heat dissipation member 20. More specifically, the first positioning projection 17 and the second positioning projection 18 of the socket 10 are respectively inserted into the third positioning hole 33 and the fourth positioning hole 34, which are formed through the board 30. Thus, the board 30 is positioned on the board support portion 21. At this time, the first conduction terminal 51 and the second conduction terminal 52, which are supported by the board 30, pass through the recess 24 of the board support portion 21 and enter the third through hole 16 which is formed through the socket 10.

As shown in FIGS. 1A, 2A, and 2B, a first fixing portion 17*a* and a second fixing portion 18*a* are formed by, for example, caulking an upper end portion of the first positioning projection 17 and an upper end portion of the second positioning projection 18, respectively. Thereby, the board 30 is fixed to the heat dissipation member 20. A heat dissipating adhesive or the like may be applied between the board 30 and the board support portion 21.

Figure 4A:
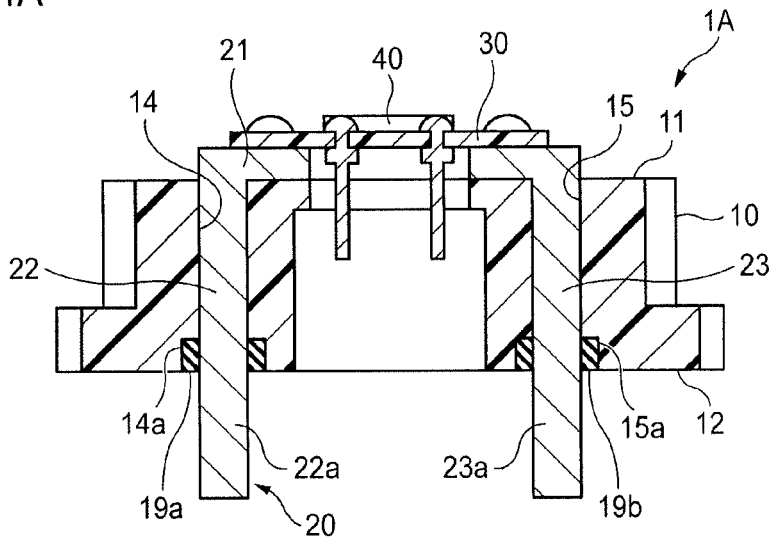
FIGS. 4A and 4B show a first modification example of the light source unit according to the first exemplary embodiment.
Figure 4B:
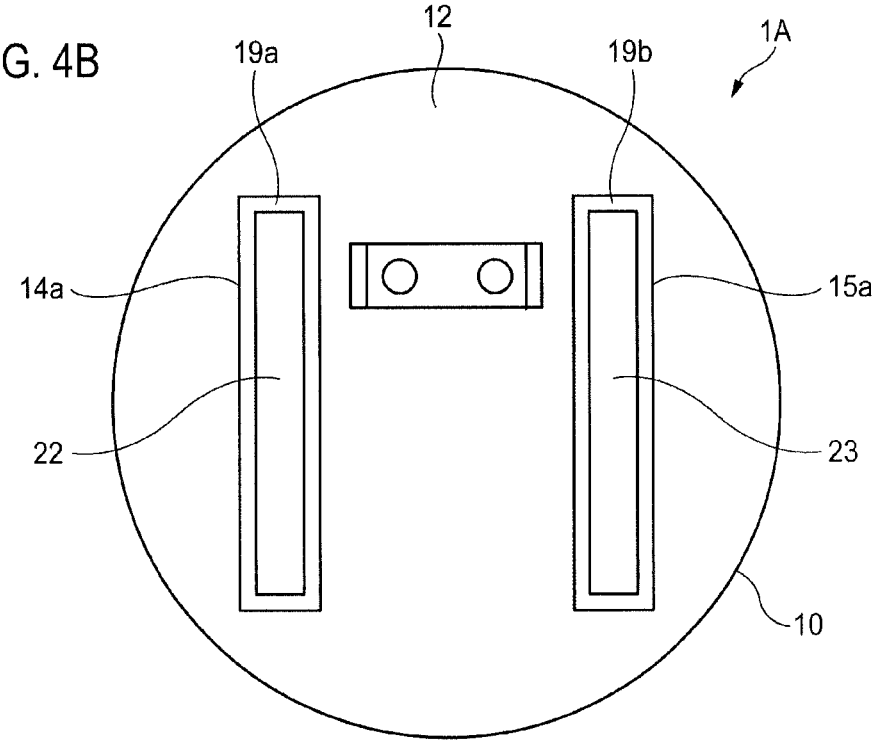

FIGS. 4A and 4B show a light source unit 1A according to a first modification example. Elements having the same or equivalent structures and/or functions as or to those of the light source unit 1 are given the same reference symbols and will not be described redundantly. FIG. 4A is a sectional view corresponding to FIG. 2A. FIG. 4B shows an appearance of the light source unit 1A when viewed from a second surface 12 side.

The light source unit 1A is equipped with a first sealing member 19*a* and a second sealing member 19*b*. each of the first sealing member 19*a* and the second sealing member 19*b* may be a gasket, an O-ring, a waterproof adhesive, or the like. The first through hole 14 has a first wide portion 14*a* that opens on the second surface 12 of the socket 10. The second through hole 14 has a second wide portion 15*a* that opens on the second surface 12 of the socket 10. In the first wide portion 14*a*, the first sealing member 19*a* surrounds the first heat dissipation plate 22. That is, the first sealing member 19*a* is disposed between an inner wall surface of the first through hole 14 and the first heat dissipation plate 22. In the second wide portion 15*a*, the second sealing member 19*b* surrounds the second heat dissipation plate 23. That is, the second sealing member 19*b* is disposed between an inner wall surface of the second through hole 15 and the second heat dissipation plate 23.

With the above configuration, even in the case where the socket 10 and the heat dissipation member 20 are integrated together by inserting the first heat dissipation plate 22 and the second heat dissipation plate 23 into the first through hole 14 and the second through hole 15, respectively, entrance of water or dust into a very small gap between the first heat dissipation plate 22 and the first through hole 14 (the socket 10) and a very small gap between the second heat dissipation plate 23 and the second through hole 15 (the socket 10) can be prevented. As a result, in providing the light source unit 1A which can secure sufficient heat dissipation performance while satisfying such demands as miniaturization and weight reduction, not only can the assembling work efficiency be enhanced but also the semiconductor light emitting element 40 can be protected from water and dust.

The method for integrating the socket 10 and the heat dissipation member 20 together is not limited to the above examples. For example, the socket 10 and the heat dissipation member 20 may be integrated by performing integration-molding such as insert molding.

In this case, since it is not necessary to form the first through hole 14 and the second through hole 15 in the socket 10, a molding die for the socket 10 can be simplified. Furthermore, since the socket 10 and the heat dissipation member 20 are fixed to each other so as to be in close contact with each other, not only can the heat dissipation performance of the heat dissipation member 20 be enhanced but also entrance of water or dust into a connection portions between the socket 10 and the heat dissipation member 20 can be prevented. Still further, since a step of inserting the first heat dissipation plate 22 and the second heat dissipation plate 23 into respective holes is not necessary, a degree of freedom to select shapes of (i) a portion, disposed inside the socket 10, of the first heat dissipation plate 22 (i.e., the portion extending from the board support portion 21 to the first projection portion 22*a*) and (ii) a portion, disposed inside the socket 10, of the second heat dissipation plate 23 (i.e., the portion extending from the board support portion 21 to the second projection portion 23*a*) is increased. For example, if each of the first heat dissipation plate 22 and the second heat dissipation plate 23 is formed so as to have an additional bent portion(s) inside the socket 10, the heat dissipation performance can be enhanced further without increase of the size of the socket 10. As a result, not only can sufficient heat dissipation performance be secured more easily while such demands as miniaturization and weight reduction of the light source unit 1 to be incorporated in an illumination device which is to be mounted in a vehicle are satisfied, but also the semiconductor light emitting element 40 can be protected from water and dust.

Figure 5A:
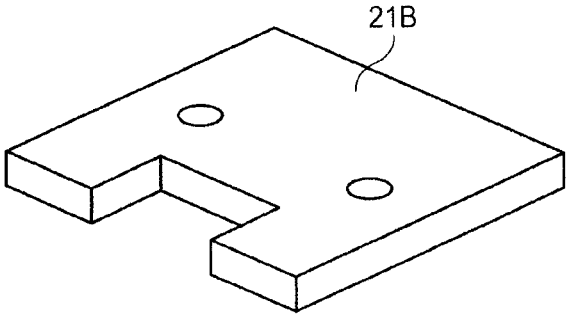
FIGS. 5A and 5B show a second modification example of the light source unit according to the first exemplary embodiment.
Figure 5B:
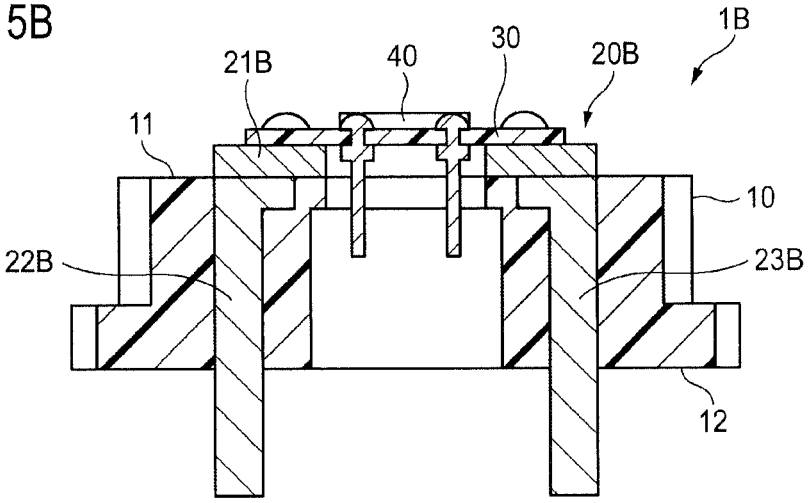

In integrating the socket 10 and the heat dissipation member 20 together, the entire heat dissipation member 20 need not always be integrated with the entire socket 10 by integral molding. For example, FIGS. 5A and 5B show a light source unit 1B according to a second modification example. Elements having the same or equivalent structures and/or functions as or to those of the light source unit 1 are given the same reference symbols and will not be described redundantly.

The light source unit 1B is equipped with a heat dissipation member 20B. The heat dissipation member 20B includes a board support portion 21B, a first heat dissipation plate 22B, and a second heat dissipation plate 23B which are separated members from each other. As shown in FIG. 5A, the board support portion 21B is a plate-like member. FIG. 5B is a sectional view corresponding to FIG. 2A.

As shown in FIG. 5B, the board support portion 21B is disposed on the first surface 11 of the socket 10. That is, the board support portion 21*b* is disposed on the first side of the light source unit 1B. The board support portion 21B extends to be in parallel to the first surface 11 (the direction parallel to the first surface 11 is an example of the first direction).

As a result of being subjected to bending processing, each of the first heat dissipation plate 22B and the second heat dissipation plate 23B has a portion that extends in a direction (an example of the second direction) intersecting with the direction in which the board support portion 21B extends. The first heat dissipation plate 22B and the second heat dissipation plate 23B are integrated together with the socket 20 by integral molding such as insert molding. The integral molding is performed so that an upper end surface of the first heat dissipation plate 22B and an upper end surface of the second heat dissipation plate 23B are exposed in the first surface 11 of the socket 10. The board support portion 21B is fixed to the upper end surface of the first heat dissipation plate 22B and the upper end surface of the second heat dissipation plate 23B by welding or adhesion.

The above-described configuration provides the same advantages as the case in which the entire heat dissipation member 20 is integration-molded together with the socket 10.

Figure 6:
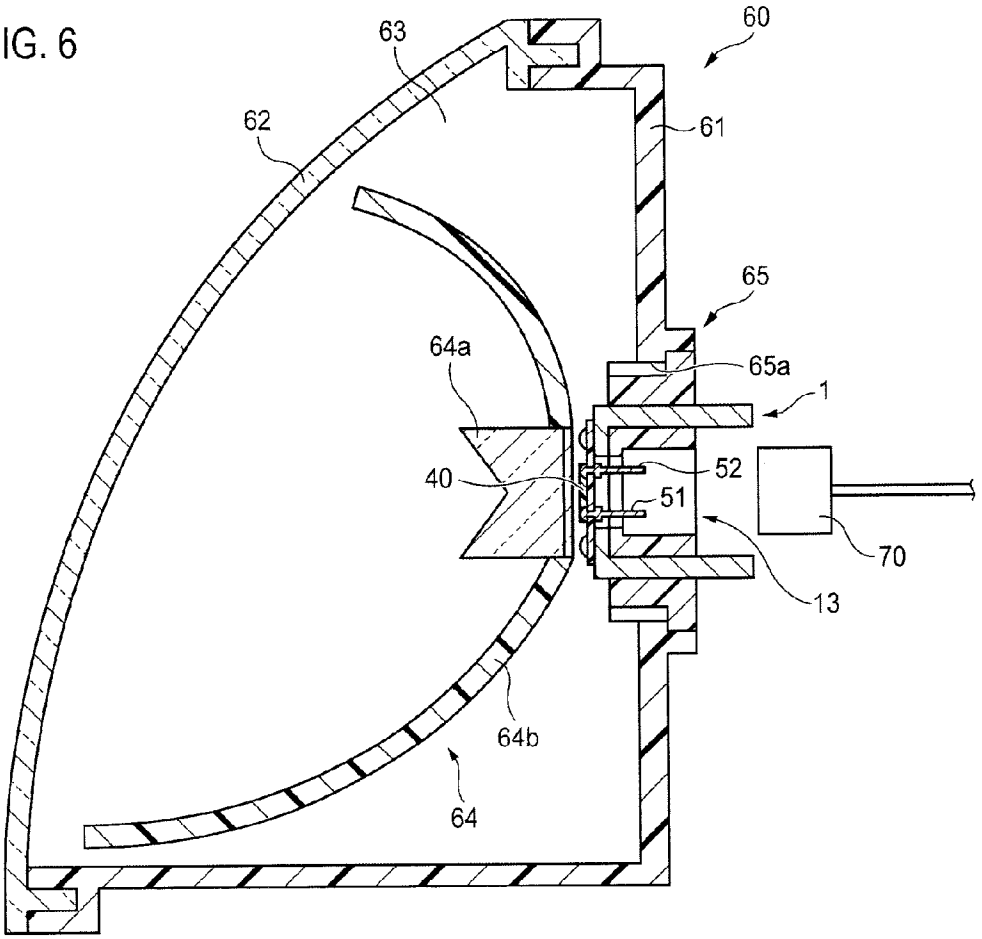
FIG. 6 is a sectional view showing a state in which the light source unit is incorporated in an illumination device.

FIG. 6 is a sectional view showing a state in which the light source unit 1 according to the first exemplary embodiment is incorporated in an illumination device 60 to be mounted in a vehicle. The illumination device 60 is equipped with a housing 61 and a transparent cover 62. The housing 61 opens on a front side. The transparent cover 62 is attached to the housing 61 so as to close the opening of the housing 61. The housing 61 and the transparent cover 62 define a lamp chamber 63.

The illumination device 60 is also equipped with an optical unit 64. The optical unit 64 is disposed in the lamp chamber 63. The optical unit 64 includes a lens 64*a* and a reflector 64*b*.

The illumination device 60 is further equipped with a light source unit mounting portion 65. The light source unit mounting portion 65 is formed in a part of the housing 61. The light source unit mounting portion 65 is formed with a through hole 65*a* that communicates the inside and outside of the lamp chamber 63 with each other. In this case, the light source unit 1 is attached to the light source unit mounting portion 65 from outside the housing 61, that is, from outside the lamp chamber 63. In this state, the semiconductor light emitting element 40 is disposed at a position where the semiconductor light emitting element 40 faces the lens 64*a* of the optical unit 64.

In this state, the connector portion 13 is disposed outside the housing 61, that is, outside the lamp chamber 63. The first conduction terminal 51 and the second conduction terminal 52 are connectable to a power supply connector 70 that electrically connects to an external power source (not shown). When the power supply connector 70 is connected to the connector portion 13, the semiconductor light emitting element 40 is electrically connected to the external power source (not shown) via the first conduction terminal 51 and the second conduction terminal 52. The first side of the light source unit 1 may be defined as a side that is located in the lamp chamber 63 in a state where the light source unit 1 is incorporated in the illumination device 60. The second side of the light source unit 1 may be defined as a side that is located outside the lamp chamber 63 in this state.

Light that is emitted from the semiconductor light emitting element 40 by power supplied from the external power source is subjected to a predetermined light orientation control by the lens 64*a* and the reflector 64*b*, and illuminates a region ahead of the illumination device 60 through the transparent cover 62.

Figure 7A:
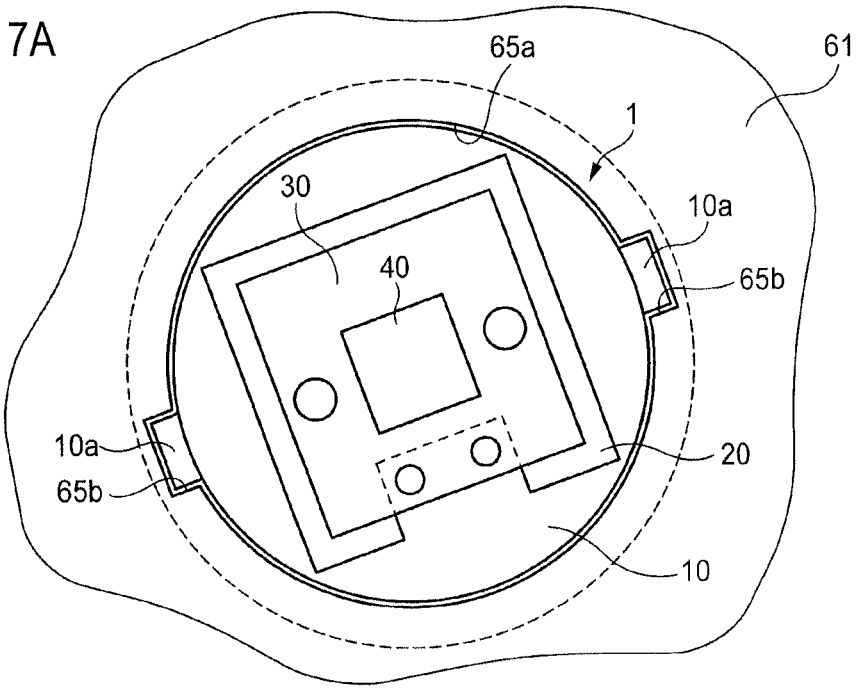
FIGS. 7A and 7B show another modification example of the light source unit according to the first exemplary embodiment.
Figure 7B:
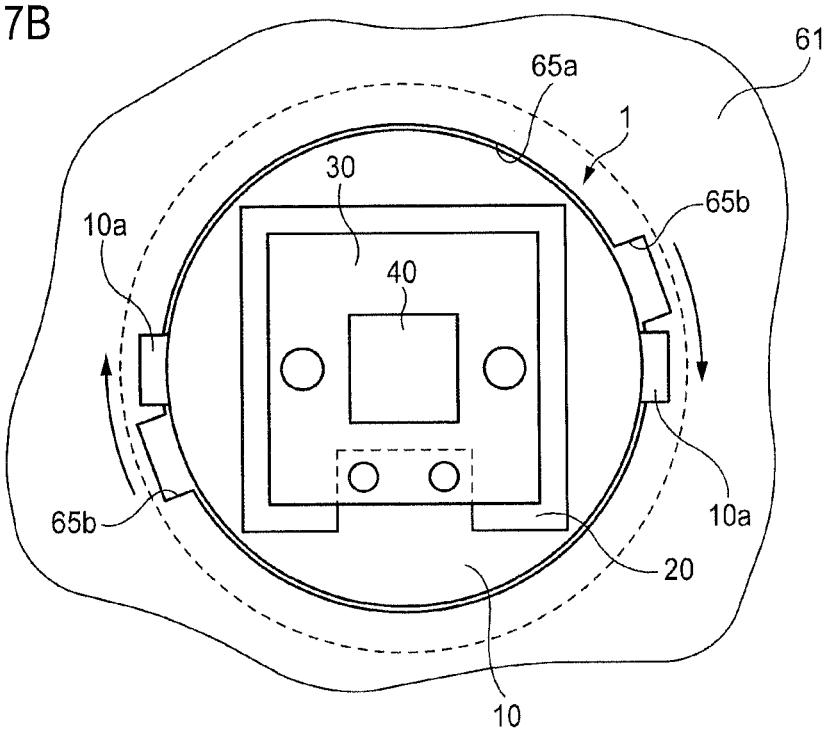

The light source unit 1 may be configured so as to be detachably attached to the light source unit mounting portion 65. In this case, as shown in FIG. 7A, plural projections 10*a* are provide on an outer circumferential surface of the socket 10. On the other hand, a part of the through hole 65*a* of the light source unit mounting portion 65 is formed with plural grooves 65*b*. The projections 10*a* are engaged with the inner surface of the housing 61 by inserting the projections 10*a* into the respective grooves 65*b* and rotating the light source unit 1 in a direction indicated by arrows in FIG. 7B. As a result, the light source unit 1 can be prevented from coming off the through hole 65*a*.

The projections 10*a* and the light source unit mounting portion 65 are disengageable from each other. When it has become necessary to, for example, replace the semiconductor light emitting element 40, the light source unit 1 is rotated in an opposite direction to the direction in which the light source unit 1 is rotated in the mounting step so that the projections 10*a* becomes movable in the respective grooves 65*b*. Thereby, the light source unit 1 can be pulled out of the light source unit mounting portion 65. As a result, access to the semiconductor light emitting element 40 is made possible.

In the above modification example, the light source unit 1 includes the pair of projections 10*a*, and the light source unit mounting portion 65 are formed with the pair of grooves 65*b*. Alternatively, the light source unit 1 may be formed with grooves, and the light source unit mounting portion 65 may include projections. The number of projections and grooves may be determined as appropriate. The engagement method is not limited to the above-described bayonet type so long as the light source unit 1 and the light source unit mounting portion 65 disengageably engage with each other. Any of other engagement structures such as lance engagement and screwing may be employed as appropriate.

In the above modification example, the light source unit mounting portion 65 is provided in the housing 61. However, as long as the light source unit mounting portion 65 can be mounted with the light source unit 1, the light source unit mounting portion 65 may be provided at a proper location in the lamp chamber 63, for example, as a part of the optical unit 64. Even the entire light source unit 1 may be disposed inside the lamp chamber 63.

The configurations described above with reference to FIGS. 6 to 7B are also applicable to (i) the light source unit 1A which has been described with reference to FIGS. 4A and 4B and (ii) the light source unit 1B which has been described with reference to FIGS. 5A and 5B.

Figure 8A:
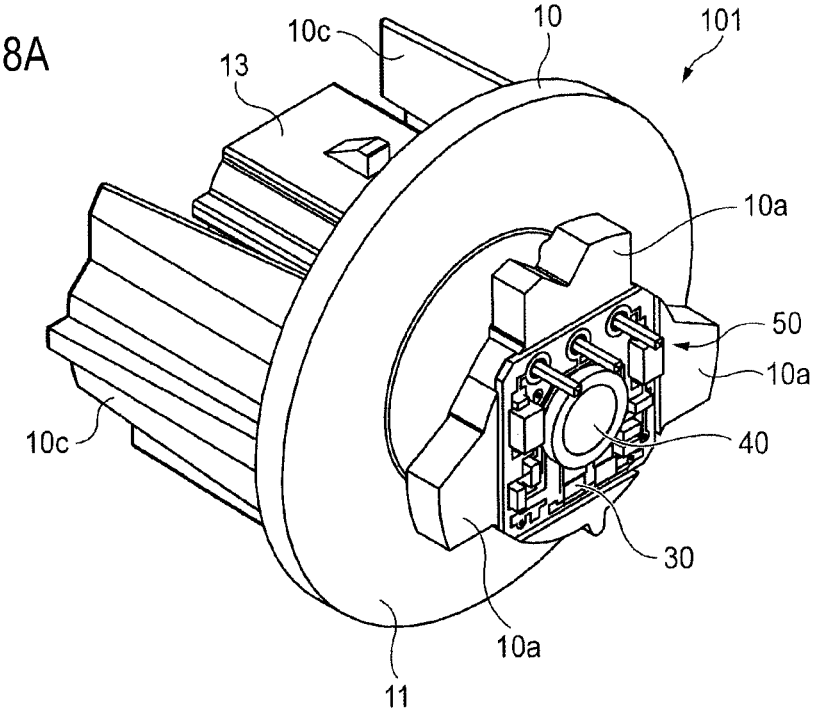
FIGS. 8A and 8B are perspective views showing appearances of a light source unit according to a second exemplary embodiment.
Figure 8B:
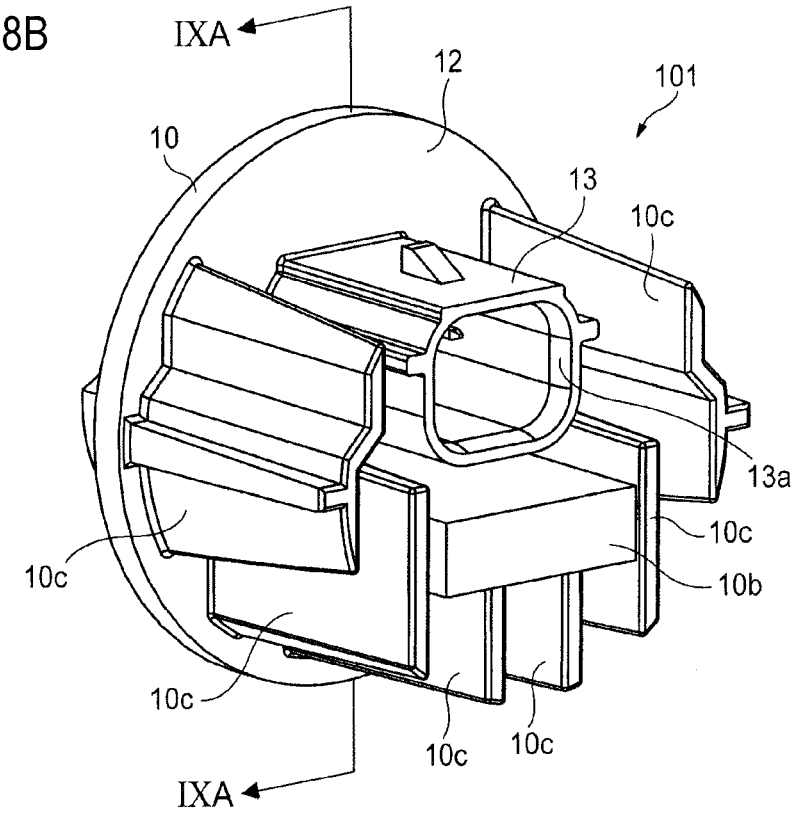

Next, a light source unit 101 according to a second exemplary embodiment will be described with reference to FIGS. 8A to 9B. Elements having the same or equivalent structures and/or functions as or to those of the light source unit 1 according to the first exemplary embodiment are given the same reference symbols and will not be described redundantly. FIG. 8A is a perspective view showing an appearance of the light source unit 101 when viewed from a side of the first surface 11 of the socket 10. FIG. 8B is a perspective view showing an appearance of the light source unit 101 when viewed from a side of the second surface 12 of the socket 10. FIG. 9A is a sectional view taken by a plane that contains a line IXA-IXA in FIG. 8B and that is perpendicular to the first surface 11 and the second surface 12 and viewed in a direction indicated by arrows.

The socket 10 is provided with a heat dissipation plate housing portion 10*b*. The heat dissipation plate housing portion 10*b* projects from the second surface 12 of the socket 10. That is, the heat dissipation plate housing portion 10*b* is disposed on the second side of the light source unit 101. As shown in FIG. 9A, a hole 10*b*1 having a bottom surface is formed in the heat dissipation plate housing portion 10*b*. The hole 10*b*1 having the bottom surface opens on the first surface 11 of the socket 10.

The socket 10 is also provided with plural heat radiation fins 10*c*. The plural heat radiation fins 10*c* project from the second surface 12 of the socket 10. That is, the heat radiation fins 10*c* are disposed on the second side of the light source unit 101.

The light source unit 101 is equipped with a heat dissipation member 120. A material of the heat dissipation member 120 is higher in thermal conductivity than that of the socket 10. That is, the socket 10 has a first thermal conductivity, and the heat dissipation member 120 has a second thermal conductivity that is higher than the first thermal conductivity. The socket 10 is an injection-molded member made from a resin material. The resin material may be mixed with glass fillers or metal powders. An example material of the heat dissipation member 120 is a metal such as aluminum.

The heat dissipation member 120 is provided with a board support portion 121 (an example of the first portion). The board support portion 121 is disposed on the first side of the light source unit 101. The board support portion 121 extends to be in parallel to the first surface 11 of the socket 10 (the direction in parallel to the first surface 11 is an example of the first direction).

The heat dissipation member 120 is also provided with a heat dissipation plate 122. As a result of being subjected to bending processing, the heat dissipation plate 122 has a portion that extends in a direction (an example of the second direction) intersecting with the direction in which the board support portion 121 extends. The heat dissipation plate 122 has a projection portion 122*a* (an example of a part of the second portion). The projection portion 122*a* projects from the second surface 12 of the socket 10. That is, the projection portion 122*a* is disposed on the second side of the light source unit 101.

The board 30 is supported by the board support portion 121 of the heat dissipation member 120. The semiconductor light emitting element 40 is supported by the board 30. That is, the board 30 and the semiconductor light emitting element 40 are disposed on the first side of the light source unit 101.

In the above-described configuration, the heat dissipation member 120 is formed in such a manner that the heat dissipation plate 122 has a portion that extends in the direction intersecting with the direction in which the board support portion 121 extends. The board support portion 121 is disposed on the first side, defined by a portion of the socket 10, of the light source unit 101. The board support portion 121 supports the board 30 which supports the semiconductor light emitting element 40. The projection portion 122*a* of the heat dissipation plate 122 is disposed on the second side, defined by the portion of the socket 10, of the light source unit 101. Heat generated by the semiconductor light emitting element 40 is guided (transferred) to the heat dissipation plate 122 via the board support portion 121 and dissipated efficiently on the second side of the light source unit 101.

Forming the heat dissipation member 120 by bending a plate member makes it possible to secure a larger surface area with a smaller volume than forming a block-shaped heat dissipation member 20C by cutting processing or the like as in a light source unit 101C of a comparative example shown in FIG. 9B. That is, as a result of being subjected to bending, the heat dissipation plate 122 of the heat dissipation member 120 is formed so as to have a portion that extends in the direction intersecting with the direction in which the board support portion 121 extends. This makes it possible to satisfy both of weight reduction and high heat dissipation performance of the heat dissipation member 120. The presence of the heat dissipation member 120 lowers the necessity to increase the volume of the socket 10 and hence enables weight reduction and miniaturization of the entire light source unit 101. As a result, sufficient heat dissipation performance can be secured while such demands as weight reduction and miniaturization of the light source unit 101 to be incorporated in an illumination device which is to be mounted in a vehicle are satisfied.

As shown in FIG. 8A, the light source unit 101 is equipped with the plural conduction terminals 50. The plural conduction terminals 50 are supported by the board 30. The plural conduction terminals 50 electrically connect to the semiconductor light emitting element 40 via circuit interconnections (not shown) formed on the board 30. For example, the plural conduction terminals 50 include a power supply terminal and a ground terminal.

As shown in FIG. 9A, the socket 10 is equipped with a connector portion 13. The connector portion 13 houses tips 50*a* of the respective conduction terminals 50. The connector portion 13 projects from the second surface of the socket 10. The connector portion 13 is formed with an opening 13*a*. The opening 13*a* opens on a tip of the connector portion 13 projecting from the second surface 12. That is, the opening 13*a* is located on the second side of the light source unit 101.

Since the socket 10 is an injection-molded member, the socket 10 can easily be molded integrally with the connector portion 13, which is relatively complex in shape. With the above-described configuration, a power supply path to the semiconductor light emitting element 40 is disposed inside the socket 10. However, since the heat dissipation member 120 is formed by bending processing, it can be miniaturized while being kept high in heat dissipation performance. A space produced resultantly can be utilized to provide the power supply path to the semiconductor light emitting element 40. As a result, although the power supply path to the semiconductor light emitting element 40 is disposed inside the socket 10, size increase of the socket 10 and resulting size increase of the light source unit 101 can be suppressed.

As shown in FIG. 9A, a tip 122*b* of the heat dissipation plate 122 is more distant, in the direction intersecting with the direction in which the board support portion 121 extends, from the board support portion 121 than the tips 50*a* of the respective conduction terminals 50 are.

To further enhance the heat dissipation performance of the heat dissipation member 120, it is preferable to increase a surface area of the projection portion 122*a* of the heat dissipation plate 122, which is disposed on the second side of the light source unit 101. With the above-described configuration, this requirement can be met easily. As a result, sufficient heat dissipation performance can be secured more easily while such demands as miniaturization and weight reduction of the light source unit 101 to be incorporated in an illumination device which is to be mounted in a vehicle are satisfied.

To integrate the socket 10 and the heat dissipation member 120 together, the heat dissipation plate 122 of the heat dissipation member 120 is inserted into the hole 10*b*1, having the bottom surface, of the heat dissipation plate housing portion 10*b* which opens on the first surface 11 of the socket 10. This enhances the assembling work efficiency in providing the light source unit 101 which can secure sufficient heat dissipation performance while satisfying such demands as miniaturization and weight reduction.

Since the hole 10*b*1 having the bottom surface and housing the heat dissipation plate 122 does not open on the second side of the light source unit 101, entrance of water or dust into a connection portion between the socket 10 and the heat dissipation member 120 can be prevented. As a result, in providing the light source unit 101 which can secure sufficient heat dissipation performance while satisfying such demands as miniaturization and weight reduction, not only the can be assembling work efficiency enhanced, but also the semiconductor light emitting element 40 can be protected from water and dust.

In this exemplary embodiment, as shown in FIG. 9A, there is a gap between the heat dissipation plate 122 and an inner wall surface of the hole 10*b*1 having the bottom surface. Alternatively, to enhance the heat dissipation performance, the heat dissipation plate 122 may be in close contact with the inner wall surface of the hole 10*b*1 having the bottom surface.

The configuration which has been described above with reference to FIGS. 6 to 7B is also applicable to the light source unit 101 according to this exemplary embodiment.

Figure 10A:
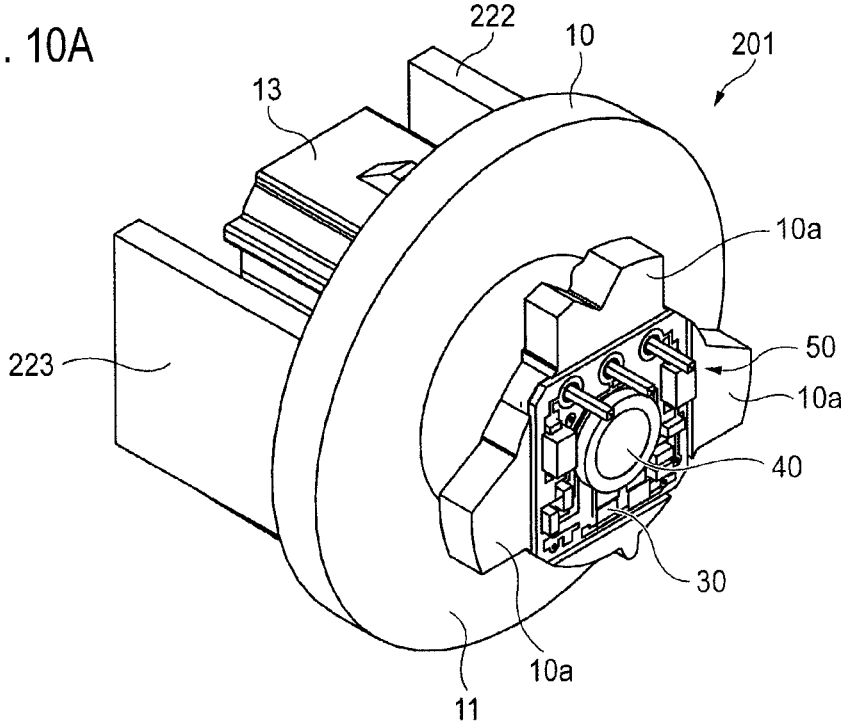
FIGS. 10A and 10B are perspective views showing appearances of a light source unit according to a third exemplary embodiment.
Figure 10B:
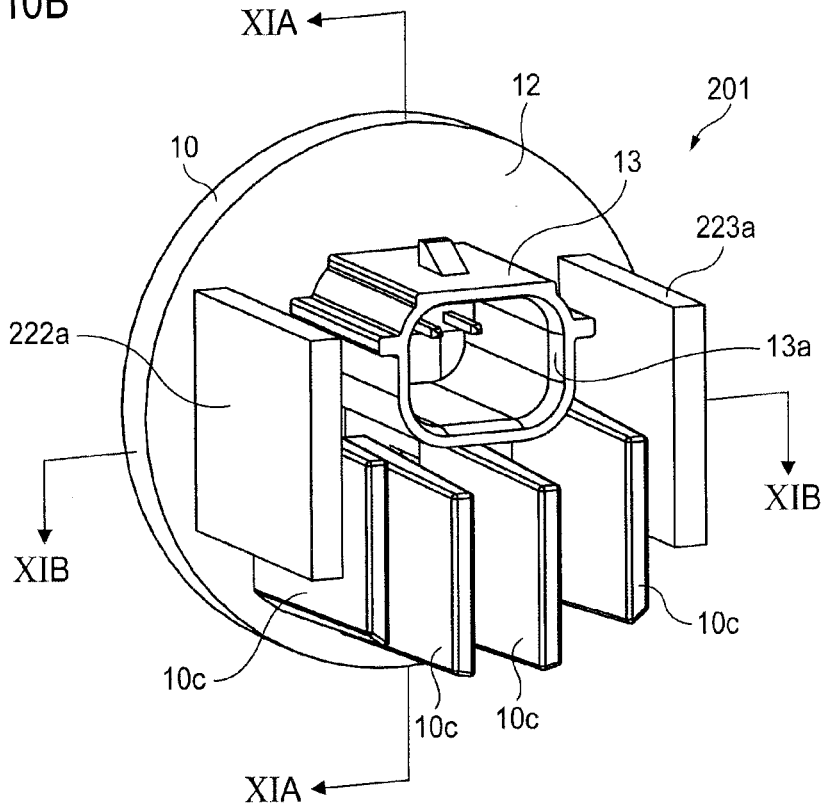
Figure 11A:
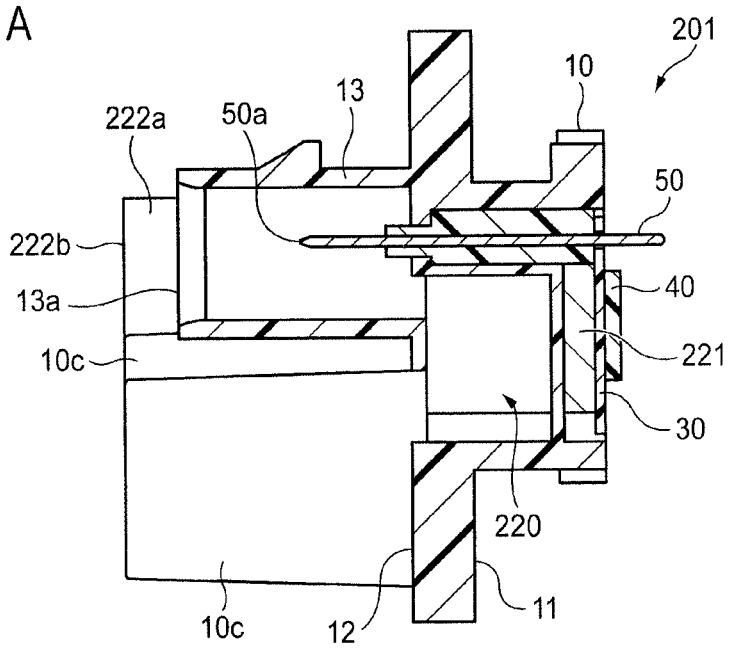
FIGS. 11A and 11B are sectional views showing the configuration of the light source unit according to the third exemplary embodiment.
Figure 11B:
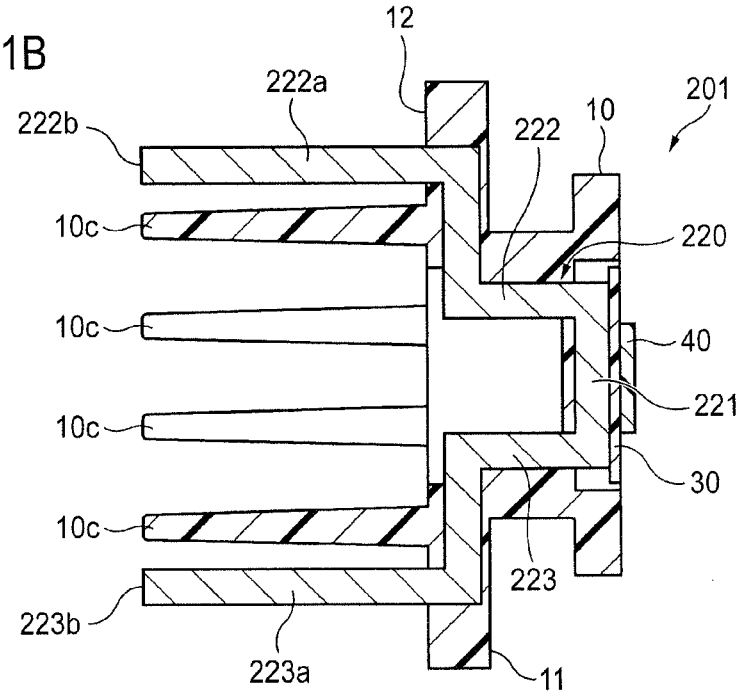

Next, a light source unit 201 according to a third exemplary embodiment will be described with reference to FIGS. 10A to 11B. Elements having the same or equivalent structures and/or functions as or to those of the light source unit 101 according to the second exemplary embodiment are given the same reference symbols and will not be described redundantly. FIG. 10A is a perspective view showing an appearance of the light source unit 201 when viewed from a side of the first surface 11 of a socket 10. FIG. 10B is a perspective view showing an appearance of the light source unit 201 when viewed from a side of the second surface 12 of the socket 10. FIG. 11A is a sectional view taken by a plane that contains a line XIA-XIA in FIG. 10B and that is perpendicular to the first surface 11 and the second surface 12 and viewed from a direction indicated by arrows. FIG. 11B is a sectional view taken by a plane that contains a line XIB-XIB in FIG. 10B and that is perpendicular to the first surface 11 and the second surface 12 and viewed in a direction indicated by arrows.

The light source unit 201 is equipped with a heat dissipation member 220. A material of the heat dissipation member 220 is higher in thermal conductivity than that of the socket 10. That is, the socket 10 has a first thermal conductivity, and the heat dissipation member 220 has a second thermal conductivity that is higher than the first thermal conductivity. The socket 10 is an injection-molded member made from a resin material. The resin material may be mixed with glass fillers or metal powders. An example material of the heat dissipation member 220 is a metal such as aluminum.

The heat dissipation member 220 is provided with a board support portion 221 (an example of the first portion). The board support portion 221 is disposed on the first side of the light source unit 201. The board support portion 221 extends to be in parallel to the first surface 11 of the socket 10 (a direction parallel to the first surface 11 is an example of the first direction).

The heat dissipation member 220 is also provided with a first heat dissipation plate 222 (an example of the second portion) and a second heat dissipation plate 223 (another example of the second portion). As a result of being subjected to bending processing, each of the first heat dissipation plate 222 and the second heat dissipation plate 223 has a portion that extends in a direction (another example of the second direction) intersecting with a direction in which the board support portion 221 extends. The first heat dissipation plate 222 has a first projection portion 222*a* (an example of a part of the second portion). The first projection portion 222*a* projects from the second surface 12 of the socket 10. That is, the first projection portion 222*a* is disposed on the second side of the light source unit 201. The second heat dissipation plate 223 has a second projection portion 223*a* (another example of a part of the second portion). The second projection portion 223*a* projects from the second surface 12 of the socket 10. That is, the second projection portion 223*a* is disposed on the second side of the light source unit 201.

The board 30 is supported by the board support portion 221 of the heat dissipation member 220. The semiconductor light emitting element 40 is supported by the board 30. That is, the board 30 and the semiconductor light emitting element 40 are disposed on the first side of the light source unit 201.

In the above-described configuration, the heat dissipation member 220 is formed in such a manner that each of the first heat dissipation plate 222 and the second heat dissipation plate 223 has a portion that extends in the direction intersecting with the direction in which the board support portion 221 extends. The board support portion 221 is disposed on the first side, defined by a portion of the socket 10, of the light source unit 201. The board support portion 221 supports the board 30 which supports the semiconductor light emitting element 40. The first projection portion 222*a* of the first heat dissipation plate 222 and the second projection portion 223*a* of the second heat dissipation plate 223 are disposed on the second side, defined by the portion of the socket 10, of the light source unit 201. Heat generated by the semiconductor light emitting element 40 is guided (transferred) to the first heat dissipation plate 222 and the second heat dissipation plate 223 via the board support portion 221 and dissipated efficiently on the second side of the light source unit 201.

Forming the heat dissipation member 220 by bending a plate member makes it possible to secure a larger surface area with a smaller volume than forming the block-shaped heat dissipation member 20C by cutting processing or the like as in the light source unit 101C of the comparative example shown in FIG. 9B. That is, as shown in FIG. 11B, as a result of being subjected to bending processing, each of the first heat dissipation plate 222 and the second heat dissipation plate 223 of the heat dissipation member 220 is formed so as to have a portion that extends in the direction intersecting with the direction in which the board support portion 221 extends. This makes it possible to satisfy both of weight reduction and high heat dissipation performance of the heat dissipation member 220. The presence of the heat dissipation member 220 lowers the necessity to increase the volume of the socket 10 and hence enables weight reduction and miniaturization of the entire light source unit 201. As a result, sufficient heat dissipation performance can be secured while such demands as weight reduction and miniaturization of the light source unit 201 to be incorporated in an illumination device that is to be mounted in a vehicle are satisfied.

As shown in FIG. 10A, the light source unit 201 is equipped with plural conduction terminals 50. The plural conduction terminals 50 are supported by the board 30. The plural conduction terminals 50 electrically connects to the semiconductor light emitting element 40 via circuit interconnections (not shown) formed on the board 30. The plural conduction terminals 50 include, for example, a power supply terminal and a ground terminal.

As shown in FIG. 11A, the socket 10 is equipped with a connector portion 13. The connector portion 13 houses tips 50*a* of the respective conduction terminals 50. The connector portion 13 projects from the second surface 12 of the socket 10. The connector portion 13 is formed with an opening 13*a*. The opening 13*a* opens on a tip of the connector portion 13, which protrudes from the second surface 12 of the socket 10. That is, the opening 13*a* is located on the second side of the light source unit 201.

Since the socket 10 is an injection-molded member, the socket 10 can easily be molded integrally with the connector portion 13 which is relatively complex in shape. With the above-described configuration, a power supply path to the semiconductor light emitting element 40 is disposed inside the socket 10. Since the heat dissipation member 220 is formed by bending processing, it can be miniaturized while being kept high in heat dissipation performance. A space produced resultantly can be utilized to form a power supply path to the semiconductor light emitting element 40. As a result, although the power supply path to the semiconductor light emitting element 40 is disposed inside the socket 10, size increase of the socket 10 and resulting size increase of the light source unit 201 can be suppressed.

As shown in FIG. 11A, a tip 222*b* of the first heat dissipation plate 222 is more distant, in the direction intersecting with the direction in which the board support portion 221 extends, from the board support portion 221 than the tips 50*a* of the respective conduction terminals 50 are. As seen from FIG. 11B, the same is true for a tip 223*b* of the second heat dissipation plate 223.

To further enhance the heat dissipation performance of the heat dissipation member 220, it is preferable to increase the surface areas of the first projection portion 222*a* of the first heat dissipation plate 222 and the second projection portion 223*a* of the first heat dissipation plate 223, which are disposed on the second side of the light source unit 201. With the above-described configuration, this requirement can be met easily. As a result, sufficient heat dissipation performance can be secured more easily while such demands as miniaturization and weight reduction of the light source unit 201 to be incorporated in an illumination device which is to mounted in a vehicle are satisfied.

As shown in FIGS. 10B and 11B, the socket 10 is provided with the plural heat radiation fins 10*c*, which are arranged on the second side of the light source unit 201. The first projection portion 222*a* of the first heat dissipation plate 222 and the second projection portion 223*a* of the second heat dissipation plate 223 are disposed outside a region where the plural heat radiation fins 10*c* of the socket 10 are arranged.

Since the socket 10 is the injection-molded member, the socket 10 can easily be molded integrally with the plural heat radiation fins 10*c* which are relatively complex in shape. This makes it possible to further enhance the heat dissipation performance of the light source unit 201. The first heat dissipation plate 222 and the second heat dissipation plate 223, which are made form a metal or the like, are higher in rigidity (for the same thickness) than the heat radiation fin 10*c*, which are injection-molded so as to be thin to increase the surface area. Providing the first projection portion 222*a* and the second projection portion 223*a* outside the region of the socket 10 where the plural heat radiation fins 10*c* are arranged makes it possible to protect, from an external force, the heat radiation fins 10*c* which are relatively lower in rigidity.

In this exemplary embodiment, since the first projection portion 222*a* of the first heat dissipation plate 222 and the second projection portion 223*a* of the second heat dissipation plate 223 are disposed on both sides of the plural heat radiation fins 10*c*, a user can attach the light source unit 201 to an illumination device by gripping the first projection portion 222*a* and the second projection portion 223*a*. This prevents the heat radiation fins 10*c* from being deformed or damaged by a force the plural heat radiation fins 10*c* receive when being gripped by a user. As a result, sufficient heat dissipation performance can be secured more easily while such demands as miniaturization and weight reduction of the light source unit 201 to be incorporated in an illumination device which is to be mounted in a vehicle are satisfied.

The socket 10 and the heat dissipation member 220 are integrated together by insert molding or the like.

In this case, since the socket 10 and the heat dissipation member 220 are fixed to each other so as to be in close contact with each other, not only can the heat dissipation performance of the heat dissipation member 220 be enhanced but also entrance of water or dust into the connection portions between the socket 10 and the heat dissipation member 220 can be prevented. Furthermore, the degree of freedom to select shapes of the portion, disposed inside the socket 10, of the first heat dissipation plate 222 (the portion from the board support portion 221 to the first projection portion 222*a*) and the portion, disposed inside the socket 10, of the second heat dissipation plate 223 (the portion from the board support portion 221 to the second projection portion 223*a*) is increased. For example, if the first heat dissipation plate 222 and the second heat dissipation plate 223 are formed so as to have additional bent portions inside the socket 10, the heat dissipation performance can be further enhanced without increase in size of the socket 10. As a result, not only can sufficient heat dissipation performance be secured more easily while such demands as miniaturization and weight reduction of the light source unit 201 to be incorporated in an illumination device that is to be mounted in a vehicle are satisfied, but also the semiconductor light emitting element 40 can be protected from water and dust.

The configurations described above with reference to FIGS. 6 to 7B are also applicable to the light source unit 201 according to this exemplary embodiment.

The above-described exemplary embodiments are just examples for facilitating the understanding of the invention. These exemplary embodiments may be modified or improved as appropriate without departing from the spirit and scope of the invention. It is also apparent that the technical scope of the invention encompasses equivalents of the exemplary embodiments.

The dimensions and the shape of the heat dissipation member 20 used in the first exemplary embodiment may be determined as appropriate according to the heat dissipation specification of the light source unit 1. For example, as indicated by two-dot chain lines in FIG. 3, each of the first heat dissipation plate 22 and the second heat dissipation plate 23 may be partitioned into plural portions by at least one slit 22*c* or 23*c*. The number of heat dissipation plates may be determined as appropriate. These are also applicable to the heat dissipation member 120 in the second exemplary embodiment and the heat dissipation member 220 in the third exemplary embodiment.

In the above exemplary embodiments, the connector portion 13 is shaped so that its opening 13*a* extends perpendicularly to the direction (an example of the second direction) intersecting with the direction (an example of the first direction) in which the board support portion 21 of the heat dissipation member 20 extends. However, the connector portion 13 may be shaped so that its opening 13*a* extends in the direction in which the board support portion 21 extends, so long as the opening 13*a* is disposed on the second side of the light source unit 1, 101, or 201.

In the above exemplary embodiments, the socket 10 includes the portion that defines the first and second sides of the light source unit 1 (1A, 1B, 101, 201). For example, the first side is a side where the first surface 11 exists. The second side is a side where the second surface 12 exists. The first side and the second side may be defined in another way. For example, the first side may be defined as a side where the semiconductor light emitting element 40 is located. The second side may be defined as a side where the tip(s) 50*a* of the conduction terminal(s) 50 are located.

What is claimed is:

1. A light source unit comprising:

a socket that has a first thermal conductivity and includes a portion that defines a first side and a second side;

a heat dissipation member that has a second thermal conductivity being higher than the first thermal conductivity;

a board disposed on the first side;

a semiconductor light emitting element supported by the board; and a conduction terminal that electrically connects to the semiconductor light emitting element, wherein the socket is an injection-molded member, and the heat dissipation member includes:

a first portion that is disposed on the first side, extends in a first direction, and supports the board, and a second portion that includes a portion extending in a second direction intersecting with the first direction, as a result of being subjected to bending processing, a part of the second portion is disposed on the second side, the socket includes a connector portion that houses a tip of the conduction terminal, the connector portion is formed with an opening that is located on the second side, and a tip of the second portion is more distant from the first portion in the second direction than the tip of the conduction terminal is.

2. The light source unit according to claim 1, wherein the socket includes plural heat radiation fins that are arranged on the second side, and the second portion is disposed outside a region where the plural heat radiation fins of the socket are arranged.

3. The light source unit according to claim 1, wherein at least part of the heat dissipation member is integration-molded with the socket.

4. The light source unit according to claim 1, wherein a hole opening on the first side is formed in the socket, and the second portion is inserted in the hole so that the heat dissipation member and the socket are integrated together.

5. The light source unit according to claim 4, wherein the hole is a through hole, the light source unit further comprising:

a sealing member that fills a space between the second portion and an inner wall surface of the through hole.

6. The light source unit according to claim 1, wherein the socket is provided with a heat dissipation plate housing portion, and the second portion is inserted into the heat dissipation plate housing portion.

7. The light source unit according to claim 1, wherein the heat dissipation plate housing portion has a hole having a bottom surface, and the second portion is in close contact with an inner wall surface of the hole having the bottom surface.

8. The light source unit according to claim 1, wherein the second portion includes the portion extending in the second direction, as a result of being subjected to bending processing.

* * * * *